US008905146B2

(12) United States Patent
Gaudette et al.

(10) Patent No.: US 8,905,146 B2
(45) Date of Patent: Dec. 9, 2014

(54) CONTROLLED ELECTROLYTIC DEGREDATION OF DOWNHOLE TOOLS

(75) Inventors: Sean Gaudette, Katy, TX (US); Wayne Furlan, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 447 days.

(21) Appl. No.: 13/324,753

(22) Filed: Dec. 13, 2011

(65) Prior Publication Data

US 2013/0146302 A1 Jun. 13, 2013

(51) Int. Cl.
*E21B 23/08* (2006.01)

(52) U.S. Cl.
USPC ..... 166/376; 166/193; 166/317

(58) Field of Classification Search
CPC ..... E21B 34/063; E21B 29/02
USPC ..... 166/376, 193, 317; 507/277
See application file for complete search history.

(56) References Cited

U.S. PATENT DOCUMENTS 6,742,491 B1 * 6/2004 Ghelfi et al. ..... 123/196 R
7,699,101 B2 * 4/2010 Fripp et al. ..... 166/229

OTHER PUBLICATIONS

Helge Halvorsen et al., "Practical Aspects of In-situ Ball Seat Milling," SPE International, SPE 147674, Copyright 2011, Society of Petroleum Engineers. Paper prepared for presentation at the SPE Annual Technical Conference and Exhibition held in Denver, Colorado, Oct. 30-Nov. 2, 2011; 1 pg.

* cited by examiner

*Primary Examiner* — Cathleen Hutchins
(74) *Attorney, Agent, or Firm* — Cantor Colburn LLP

(57) ABSTRACT

A downhole assembly with controlled degradation including a body having a cavity therein and is formed from a first material having a first electrode potential. An insert is disposed in the cavity, the insert electrically coupled to the body and formed from a second material having a second electrode potential, with the first electrode potential being more negative than the second electrode potential.

15 Claims, 1 Drawing Sheet

CONTROLLED ELECTROLYTIC DEGREDATION OF DOWNHOLE TOOLS

BACKGROUND

In the downhole drilling and completions industry it is not uncommon for it to be desirable to remove an installed tool or component after the tool has been used and is no longer needed. For example, the tool could be a lock, lug, slip, ball, plug, seat, etc. or portion thereof, and removal of the component could enable fluid flow through a previously impeded pathway, release of a lock or anchor, etc. Current systems for removing downhole components include pumping balls or plugs back up hole, milling the components out, spotting acid or other chemicals to dissolve components, etc. While these methods do work, the industry is always desirous of alternatives for effecting removal of downhole components.

SUMMARY

A downhole assembly with controlled degradation including a body having a cavity therein, the body formed from a first material having a first electrode potential; and an insert disposed in the cavity, the insert electrically coupled to the body and formed from a second material having a second electrode potential, the first electrode potential being more negative than the second electrode potential.

A method of controlling degradation of a downhole assembly including forming a cavity in a body, the body formed from a first material having a first electrode potential; and disposing an insert into the cavity, the insert electrically coupled to the body and formed from a second material having a second electrode potential, the first electrode potential being more negative than the second electrode potential.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
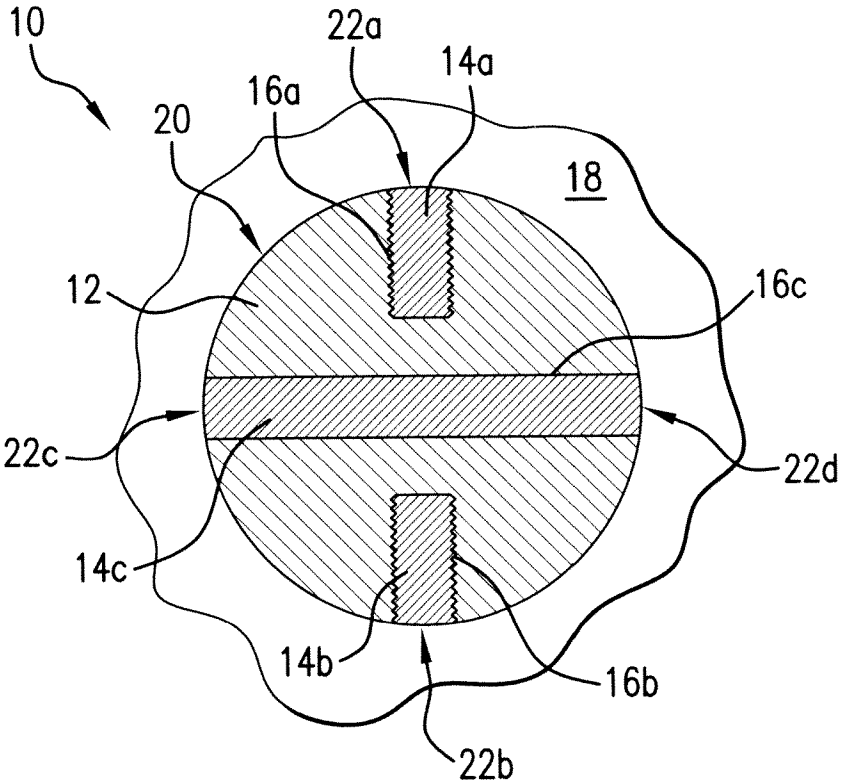
FIG. 1 is a cross-sectional view of a controlled degradation assembly.

Referring now to FIG. 1, an assembly 10 is shown. The assembly 10 includes a body 12 and at least one insert 14 (shown individually as the inserts 14*a*, 14*b*, and 14*c*, although referred to collectively as the "inserts 14"). The assembly 10 could be, for example, any downhole tool or component of which removal is desired after use thereof. For example, the assembly 10 could be a valve, a ball, a plug, a dart, a seat, a slip, a lock, a lug, an anchor, a sleeve, etc. or combinations or portions thereof. Although shown circular in cross-section, the body 12 could have any regular or irregular shape or cross-section and the Figures are provided for the purposes of illustrating one embodiment only.

The inserts 14 are each installed in corresponding cavities 16 in the body 12 (the cavities 16*a*, 16*b*, and 16*c* corresponding respectively to the inserts 14*a*, 14*b*, and 14*c*, and referred to collectively as the "cavities 16"). The cavities 16 could be formed in any desired way either during or after manufacture of the body 12. For example, drilling or some other machining operation could be performed after the body 12 is shaped, or the cavities 16 could be formed during a manufacturing process of the body 12, such as forging, compacting, molding, etc. e.g., by shaping molten metal around a mold or die, with a punch or ram, etc. for example. The inserts 14 could be installed in the cavities 16 in any manner that electrically couples the inserts 14 to the body 12. For example, in one embodiment the inserts 14 and the cavities 16 are complementarily threaded (e.g. see the inserts 14*a* and 14*b* and corresponding cavities 16*a* and 16*b*), while in another embodiment a press or interference fit is used (e.g., see the insert 14*c* in the cavity 16*c*). The inserts 14 when threaded could be notched or keyed for engagement with a suitable tool, e.g., resembling set screws drivable with a screwdriver.

Cathodic protection (CP) is a well known practice for controlling corrosion in buildings, bridges, ship hulls, etc. In general, CP involves forming an electrochemical cell with an anode and a cathode disposed in an electrolytic solution. By selecting the anode as a material that is more "galvanically active" than the material of the cathode, the anode will undergo oxidation in lieu of the cathode, thereby sacrificing itself in order to protect the cathode from corrosion. Typical materials for sacrificial anodes include magnesium, zinc, aluminum, etc., e.g., for protecting copper, steel, cast iron, etc. In general, the galvanic or electropotential series can be consulted for forming pairs of suitable materials, with the anodic material selected to have a relatively lower (more negative) electrode potential and the cathodic material having a relatively higher (more positive) electrode potential.

Advantageously, the concept of cathodic protection can be essentially used in reverse for effecting removal of a downhole component, e.g., the assembly 10. That is, opposite to protection, a structure, namely the body 12, can be corroded or degraded by creating an electrochemical cell in which the body 12 is an anode. That is, for example, an electrochemical cell is created by disposing the assembly 10 into an electrolytic solution 18 and forming the body 12 from a more active galvanic material than that of the inserts 14. The electrolytic solution 18 could be one or more downhole fluids, such that simply running or dropping the assembly 10 downhole begins the galvanic corrosion process. It is to be noted that the term fluid is used broadly to include fluids mixed with solids (e.g., mud), fluids having dissolved solids (e.g., brine), etc.

In one embodiment, the body 12 is formed from magnesium, generally the most galvanically active material, and the inserts 14 are formed from zinc, a less galvanically active material, although other combinations of materials are of course possible. By selecting a material having a relatively more negative potential for the body 12 than the material for the inserts 14, the body 12 will corrode, acting as a sacrificial anode for protecting the inserts 14. Of course, it is not that the inserts 14 are desired to be protected, but rather that the body 12 is desired to be corroded.

The corrosion or degradation rate of the body 12 can be controlled by various factors. For example, the relative volume of the body 12 in comparison to that of the inserts 14, the relative sizes of the surface areas in contact with the electrolytic solution 18 (e.g., area of the outer surface 20 of the body 12 in comparison to the sum of the areas of a plurality of surfaces 22*a*-22*d* of the inserts 14), the difference between the electrode potentials of the materials forming the body 12 and the inserts 14, etc. all affect the rate of corrosion of the body 12. Advantageously, this enables the corrosion rate of the body 12 to be predictably tuned, tailored, or controlled, e.g., by selecting appropriate materials and relative shapes and sizes for the body 12 and the inserts 14. Accordingly, it is to be appreciated that any number of inserts 14 could be included for either controlling the ratio of volumes and/or surface areas between the body 12 and the inserts 14. As another example, the inserts 14 could be installed partially (e.g., see the inserts 14*a* and 14*b*) or entirely (e.g., see the insert 14*c*) through the body 12.

Further, different ones of the inserts 14 could be different galvanic materials for enabling an even finer tuning of the corrosion rate of the body 12. For example, the body 12 could be magnesium and the inserts could be combinations of other less active galvanic materials such as zinc, aluminum, steel, cast iron, etc. Of course, the body 12 could be any of zinc, aluminum, steel, cast iron, etc., as long as the inserts 14 are relatively less active galvanic materials, e.g., nickel, stainless steel, graphite, etc.

In one embodiment, the corrosion of the body 12 is desired to be initially delayed and inserts 14 are formed from two or more materials, with one having an electrode potential greater than that of the material of the body 12, and the other less than that of the material of the body 12. For example, the inserts 14*a* and 14*b* could be formed from magnesium, the body 12 from zinc, and the insert 14*c* from aluminum. In this embodiment, the inserts 14*a* and 14*b* would corrode away first, delaying corrosion of the body 12, which would begin to corrode when the inserts 14*a* and 14*b* are gone. It is to be noted that the electrode potentials of the various materials given herein may change depending on other factors such as salinity of the solution 18, downhole temperature, etc. and that generally the body 12 is to be selected as a galvanic material that is more active (i.e., more negative) than the material of at least one of the inserts 14 under the conditions in which the assembly 10 is used.

Figure 2:
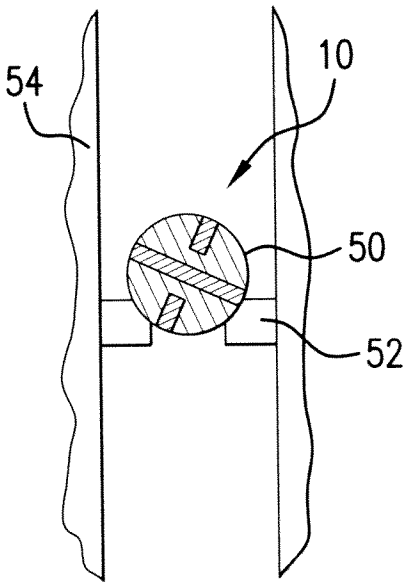
FIG. 2 schematically illustrates the assembly of FIG. 1 used as a plug for impeding flow through a tubular.

In the embodiment shown in FIG. 2, the assembly 10 forms a plug 50 that lands at a seat 52 for preventing fluid flow through a tubular 54. Fluids present in the tubular 54 will complete an electrochemical cell with the assembly 10. Due to the resulting electrochemical cell, the body 12 is arranged be corroded away, thereby enabling fluid flow through the seat 52 without the need to back pump the plug 50 or remove the plug 50 by milling. For example, the tubular 54 is a downhole production tubular and removing the plug 50 enables production therethrough. In another example, the assembly 10 is part of a lock or anchoring system, and corrosion of the body 12 results in release of the lock or anchor. Of course, the assembly 10 could be, or be part of, any other tool or component desired to be removed downhole. Although the inserts 14 are preserved from being corroded when part of the electrochemical cell, the inserts 14 can have a relatively small size for providing effectively no interference with downhole activities after the body 12 has been corroded. Further, the inserts 14 can be created from a material that is relatively easily corrodible in the absence of a sacrificial anode, such that when the body 12 is sufficiently corroded and the inserts 14 break loose therefrom, the inserts 14 will undergo corrosion until they too are dissolved, corroded, or degraded by downhole fluids.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole assembly with controlled degradation, comprising:

a body having a plurality of cavities therein, the body formed from a first material having a first electrode potential;

a first insert disposed in one of the plurality of cavities, the first insert being electrically coupled to the body and formed from a second material having a second electrode potential, the first electrode potential being more negative than the second electrode potential; and a second insert disposed in another of the plurality of cavities the second insert being formed from a third material having a third electrode potential different than the first and second electrode potentials, the third electrode potential being more negative than the first electrode potential to delay corrosion of the body until the second insert is corroded.

2. The assembly of claim 1, wherein the body corrodes in response to the assembly being subjected to an electrolytic solution.

3. The assembly of claim 2, wherein the electrolytic solution comprises a downhole fluid.

4. The assembly of claim 1, wherein at least one of the first insert and the second insert is threaded in the cavity.

5. The assembly of claim 1, wherein at least one of the first insert and the second insert is press fit into the cavity.

6. The assembly of claim 1, wherein the first material includes magnesium, zinc, aluminum, and combinations including the foregoing.

7. The assembly of claim 1, wherein the second material includes zinc, aluminum, steel, and combinations including the foregoing.

8. The assembly of claim 1, wherein the assembly forms at least a portion of a ball, plug, dart, sleeve, slip, lock, lug, anchor, or combinations including at least one of the foregoing.

9. A method of controlling degradation of a downhole assembly comprising:

forming a plurality of cavities in a body, the body formed from a first material having a first electrode potential;

disposing a first insert into one of the plurality of cavities, the first insert being electrically coupled to the body and formed from a second material having a second electrode potential, the first electrode potential being more negative than the second electrode potential; and disposing a second insert into another of the plurality of cavities, the second insert being electrically coupled to the body and formed from a third material having a third electrode potential, the third electrode potential being more negative than the first electrode potential.

10. The method of claim 9, further comprising corroding the body by exposing the body, the first insert and the second insert to an electrolytic solution.

11. The method of claim 9, wherein the electrolytic solution comprises one or more downhole fluids.

12. The method of claim 9, further comprising tuning a corrosion rate of the body by setting a ratio of volumes of the body and the inserts.

13. The method of claim 9, further comprising tuning a corrosion rate of the body by setting a ratio of exposed surface areas of the body and the inserts.

14. The method of claim 9, further comprising tuning a corrosion rate of the body by setting a difference between the first, the second, and the third electrode potentials.

15. The method of claim 9, wherein forming the plurality of cavities includes machining, forging, molding, or combinations including at least one of the foregoing.

* * * * *